US009995208B2

(12) United States Patent
Schnyder

(10) Patent No.: US 9,995,208 B2
(45) Date of Patent: Jun. 12, 2018

(54) OSCILLATING PISTON ENGINE HAVING A POLYGONAL PISTON

(71) Applicant: Hermann Schnyder, Horw (CH)

(72) Inventor: Hermann Schnyder, Horw (CH)

( * ) Notice: Subject to any disclaimer, the term of this patent is extended or adjusted under 35 U.S.C. 154(b) by 902 days.

(21) Appl. No.: 14/397,170

(22) PCT Filed: Apr. 22, 2013

(86) PCT No.: PCT/CH2013/000067
§ 371 (c)(1),
(2) Date: Oct. 24, 2014

(87) PCT Pub. No.: WO2013/159239
PCT Pub. Date: Oct. 31, 2013

(65) Prior Publication Data

US 2015/0068480 A1 Mar. 12, 2015

(30) Foreign Application Priority Data

Apr. 26, 2012 (CH) ..... 576/12

(51) Int. Cl.

| | |
|---|---|
| ***F02B 53/00*** | (2006.01) |
| ***F01B 13/06*** | (2006.01) |
| ***F02B 53/02*** | (2006.01) |
| ***F01C 1/32*** | (2006.01) |
| ***F01C 1/344*** | (2006.01) |
| ***F01C 9/00*** | (2006.01) |
| ***F02F 3/28*** | (2006.01) |

(52) U.S. Cl.
CPC ..... *F02B 53/02* (2013.01); *F01C 1/32* (2013.01); *F01C 1/344* (2013.01); *F01C 9/002* (2013.01); *F02F 3/28* (2013.01); *F04C 2250/20* (2013.01); *F04C 2250/30* (2013.01)

(58) Field of Classification Search
CPC .. F01C 1/32; F01C 1/344; F01C 9/002; F02F 3/28
USPC ..... 123/242–244, 246, 44 R, 44 D
See application file for complete search history.

(56) References Cited

U.S. PATENT DOCUMENTS

| | | | |
|---|---|---|---|
| 3,964,442 | A | 6/1976 | Hunter |
| 4,209,001 | A | 6/1980 | Miles |
| 2007/0215094 | A1 | 9/2007 | Nagata |

FOREIGN PATENT DOCUMENTS

| | | | | |
|---|---|---|---|---|
| CA | 2871248 | A1 * | 10/2013 | ..... F01C 1/32 |
| CH | 555470 | | 12/1974 | |
| WO | 2009022888 | | 2/2009 | |

* cited by examiner

*Primary Examiner* — Ngoc T Nguyen
(74) *Attorney, Agent, or Firm* — Lucas & Mercanti, LLP

(57) ABSTRACT

An engine housing has the shape of a regular dodecagonal, and includes a piston of the same shape that moves with a circular pivot movement about the axis of a main shaft. The piston is guided in parallel by three crankshafts synchronously rotating about this center of rotation. Through this pivot movement, the piston in six combustion chambers each consecutively brings about the four cycles of a spark ignition or diesel engine. The three crankshafts are in permanent engagement through gears which are attached in a fixed manner with a sun wheel, which is seated on a main shaft in a fixed manner, driving it.

3 Claims, 3 Drawing Sheets

OSCILLATING PISTON ENGINE HAVING A POLYGONAL PISTON

CROSS-REFERENCE TO RELATED APPLICATIONS

This application is a 371 of PCT/CH2013/000067 filed Apr. 22, 2013, which in turn claims the priority of CH 576/12 filed Apr. 26, 2012, the priority of both applications is hereby claimed and both applications are incorporated herein by reference.

BRIEF SUMMARY OF THE INVENTION

The present invention relates to an oscillating piston machine with polygonal piston. Morphologically, the oscillating piston machine has similarities to the known rotary piston engine by Wankel, with the difference that only the combustion chambers functionally move. This invention is a further development of the patent publication that has become known by the same inventor under CH 555 470 so that this earlier patent publication is the closest prior art. In the narrow sense, the invention relates to an oscillating piston engine according to the preamble of Patent claim 1.

BRIEF DESCRIPTION OF THE DRAWINGS

With the help of the attached drawing, the subject of the invention is explained in more detail. It shows FIG. 1 a sectional drawing through the engine housing from the side of the combustion chambers, partly opened, FIG. 2 the same sectional drawing from the opposite side, FIG. 3 an axial section through the engine.

DETAILED DESCRIPTION OF THE PREFERRED EMBODIMENTS

Figure 1:
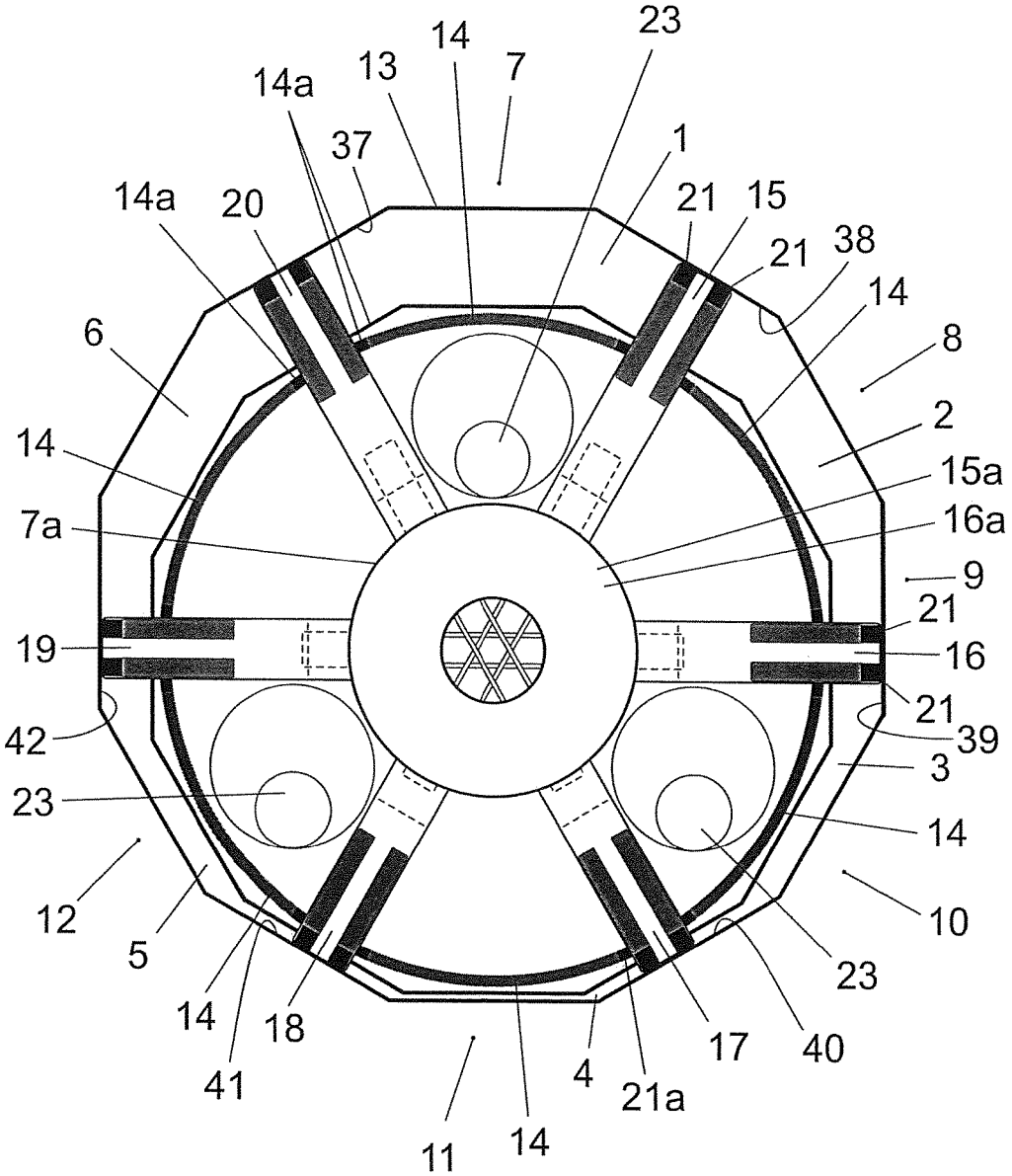

FIG. 1 is an axial section through the housing of the engine according to the invention looking into in this case six combustion chambers 1-6 of the engine. Each of the combustion chamber 1-6 is bounded by a sector 7-12 of a housing of the engine designated 13, towards the inside by sealing strips 14, 14*a*, corresponding to piston rings of a spark-ignition or diesel engine of conventional design, from combustion chamber to combustion chamber by a part wing of double wings 15-20, or sealing strips 21 sealing these. Since subject to mechanical wear, the ends of the sealing strips 14, 14*a*, 21, 21*a* are hardened for example. The main component shown here, which also brings about and defines the variable sizes of the combustion chambers 1-6, is a piston 22, which, guided in parallel by three crankshafts 23, brings about the circular oscillation of the piston 22, thus creating the variable sizes of the combustion chambers 1-6.

These three crankshafts 23 are each connected to a satellite wheel 46 in a fixed manner, which rotates about a sun wheel 47. On this driving side, the crank mountings which are subjected to major load are lubricated and cooled according to the dry sump pressure lubricating system. The excess lubricating oil is returned to the lubricating circuit via a return line 49.

Figure 2:
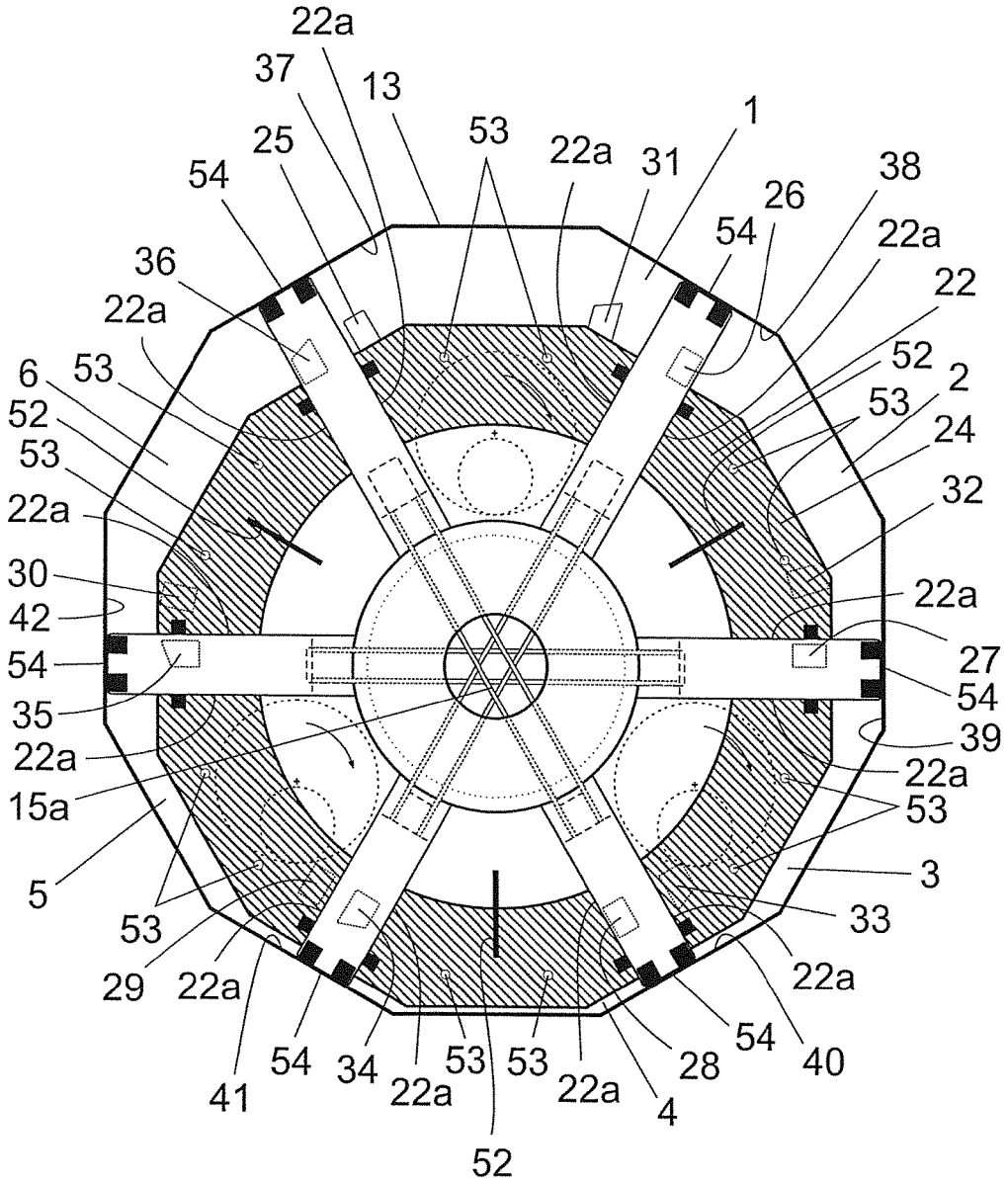

In FIG. 2 the opposite side of FIG. 1 is visible. Shown hatched is an area 24 of the piston 22 which is in permanent sliding contact with the wall of the housing 13 therefore requiring lubrication. In the area 24 of the piston 22 and in radial grooves 22*a*, openings 53 for fresh lubricating oil are provided at regular intervals, which lubricating oil is introduced there under pressure in a metered manner. Through the oscillation movement of the piston 22 the latter or the part wings 15-20 exposes one after the other in the cycle of this movement the partly covered, i.e. shown in dashed line, inlet and exhaust ports 25-30 and 31-36 of the combustion chambers 1-6.

The part wings 15-20 of the double wings are rigidly connected to one another in pairs each through optional rods or strips 15*a*. These are offset relative to one another axially to the axis of the engine so that the movement of the double wing can take place without obstruction.

The four cycles of a spark ignition or diesel engine are described in the following with the help of the combustion chambers 1-6:

Combustion chamber 1:

inlet port 25 and exhaust port 31 are opened. The fresh air under pressure flows through the inlet port 25 into the combustion chamber 1, displaces the mixture that is present and combusted in the combustion chamber 1; at the same time the combustion chamber 1 is recharged with fresh air.

Combustion chamber 2:

inlet port 26 and exhaust port 32 are closed; the volume of combustion chamber 2 is decreased.

Combustion chamber 3:

both openings 27 and 33 remain closed; the volume of the combustion chamber 3 continues to be decreased.

Combustion chamber 4:

the content of combustion chamber 4 is compressed to a maximum. Depending on engine type spark ignition/diesel engine, the fuel is now injected and ignition initiated thereafter. Spark or glow plugs are not drawn in since their location can be influenced by design measures.

Combustion chamber 5, 6:

power cycle: this commenced directly after the ignition operation and extends again as far as into the combustion chamber 1. Since the piston 22 does not have any stationary state and thus also no dead centre, the power cycle can be freely extended; this increases the energy utilisation of the fuel and lowers the pollutant emission.

The expansion of the combustion gases progresses. Inlet port 30 opens for fresh air; afterburning is initiated.

What is described here one after the other for combustion chambers 1-6 however occurs simultaneously, stepped in time, in the combustion chambers 1-6.

In order to prevent that backfiring from a combustion chamber into the preceding one can occur, the exhaust lines of the combustion chambers 1, 3, 5 and those of the combustion chambers 2, 4, 6 are each connected to separate exhaust pipes. The mentioned injection of the fuel is effected by way of injection pumps according to the state of the art. The start of the engine is effected through compressed air from the compressed air reservoir, initially without injection of fuel, until the engine has reached a rotational speed at which it can continue running independently.

Figure 3:
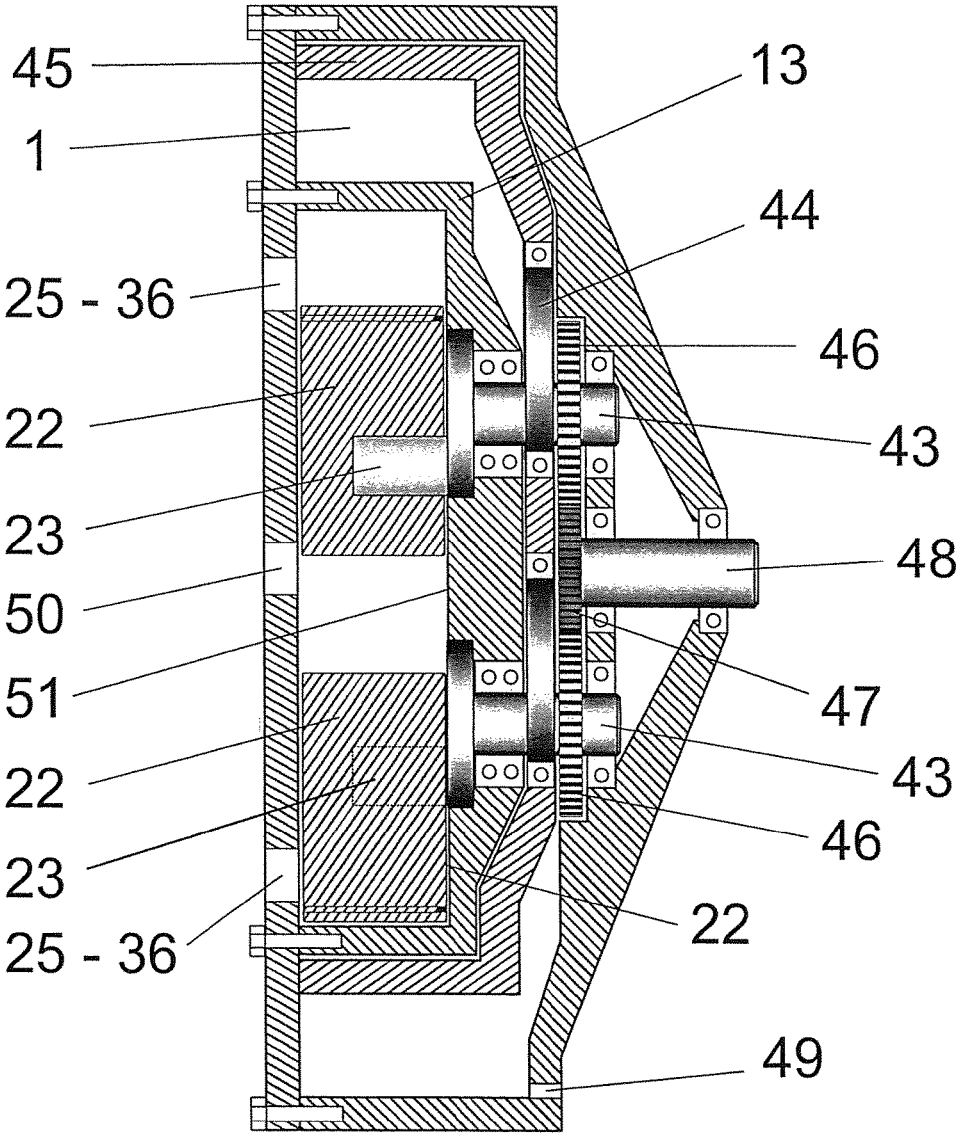

FIG. 3 shows an axial section through the piston 22, which only functionally represents a piston, and with respect to the shape is formed by in this case a dodecagonal disc. This disc, called piston 22, oscillates, guided by the three crankshafts 23 during the four cycles of each combustion chamber 1-6, once about 360° laterally taking along the three double wings 15-20 inserted in the piston 22 in grooves 22*a*, so that these follow the oscillation movement of the piston only in a projection to that side of the engine interior, on which in each case the double wings 15-20 stand perpendicularly. The three satellite wheels 46, on which the three crankshafts 23 are each seated in a fixed manner, are in permanent engagement with a sun wheel 47, which in turn is seated in a fixed manner on a main shaft 48. This main shaft 48 is the output axle of the engine according to the invention.

The outer ends of the double wings 15-20 are moved, during this one revolution of the piston 22 over the entire length of part sides 37-43 of the interior, and seal with inserted sealing strips 21*a* together with the sealing strips 21 inserted in longitudinal direction of the part wings, the combustion chambers 1-6 against one another. The sealing strips 14 which radially run in the piston 22, together with the sealing strips 14*a* located transversely to the engine, seal the combustion chambers 1-6 towards the engine centre.

Lubrication is effected by an oil mist, which is created and transported by the fresh air flowing in under pressure. Since in the combustion chambers 1-6 there is always a positive pressure no lubricating oil can enter these combustion chambers. Because of an unavoidable leakage airflow, the oil mist is forced into the centre of the engine from all combustion chambers, from where it is extracted through an opening 50 and fed to a vessel for recycled oil for renewed usage. Lubricating oil input laterally is mixed into a leakage air oil mist after the lubrication of the engine and extracted by the following compressor for the continuous lubrication and separated for reuse in the compressed-air vessel.

Here it is also shown how mass balancing is managed: a shell-shaped structure surrounds the drive component of the engine. This structure is a balancing mass 45, driven by satellite wheels 46 and eccentric discs 44. Thus, the engine can be not only into the static but also into the dynamic equilibrium. The radial orientation of the balancing mass 45 is always exactly opposite to that of the piston 22 through the position of the eccentric discs 44. Since each of the circularly moving masses, namely those of the piston 22 and those of the non-central component of the balancing mass 45 on their own are always identical in size and their spacing from the centre of a main shaft 48 is additionally constant, a constant moment of inertia for each is obtained. By way of which the dynamic equilibrium is realised; any deviations of a production nature can be rectified through spot reworking. This is made easier since the shell of the balancing mass 45, except for its middle part, does not touch any other parts of the engine anywhere.

In principle, the engine according to the invention is lubricated through the oil mist moistened fresh air. To this end, the fresh air is compressed in a compressor and prior to the output into the engine enriched with lubricating oil in the form of an oil mist. A separating wall 51 ensures the separation of the lubricating systems in the region of the engine. The area 24 of the piston 22 requires lubrication as a matter of principle since in permanent contact with the piston 22 and the part wings 15-20; likewise the lateral surfaces and the end faces of the double wings 15-20. Channels 52 collect the locally excess oil for redistribution in the region of the piston 22. The excess oil is discharged, filtered and fed to a vessel for recycled oil. From there it can be reused. Further advantages of the invention are:

- all sliding surfaces are flat: in terms of production, simple, no valves,
- simple and accurate control of the inlet and exhaust ports through clearance-free sliding over by the piston and wing lateral surfaces,
- the engine according to the invention does not have any cold and warm zones; the heat development is evenly distributed all round,
- static and dynamic equilibrium of the moving parts of the engine,
- no engine overloading through dead centres, exhaust ports can therefore be opened later,
- the output rotational speeds can be adapted through design by the size of the satellite wheels,
- no piston alternating loading thanks to chamber permanent positive pressure,
- engine is started with compressed air.

The invention claimed is:

1. An oscillating piston engine, comprising:

a polygonal piston;

a housing having a regular polygonal interior of a same general shape as the piston, when viewed in an axial section;

a main shaft, on which a sun wheel is seated in a fixed manner and in turn drives three satellite wheels, each of the satellite wheels being seated on a respective crankshaft, which puts the piston in a circularly oscillating motion with parallel guidance about the main shaft, and which main shaft represents the output shaft of the engine;

wherein the polygonal interior of the housing is functionally subdivided into six combustion chambers, including a first combustion chamber, a second combustion chamber, a third combustion chamber, a fourth combustion chamber, a fifth combustion chamber, and a sixth combustion chamber;

wherein each combustion chamber has an inlet port and an exhaust port so that the first combustion chamber has a first inlet port and a first exhaust port, the second combustion chamber has a second inlet port and a second exhaust port, the third combustion chamber has a third inlet port and a third exhaust port, the fourth combustion chamber has a fourth inlet port and a fourth exhaust port, the fifth combustion chamber has a fifth inlet port and a fifth exhaust port, and the sixth combustion chamber is a sixth inlet port and a sixth exhaust port;

wherein three double wings with part wings crossing one another are arranged in the housing, said double wings having part wings, which are individually displaceable longitudinally by sliding in fitting radial grooves of the piston, and which seal the polygonal interior of the housing in tangential direction by means of sealing strips, wherein the two part wings of one of the double wings are each connected through rods which run radially;

wherein the piston in each combustion chamber in a tangentially circumferential groove carries a sealing strip, which seals the combustion chambers radially inwardly; and a shell-shaped balancing mass arranged to surround a drive part of the engine and be moveable through three eccentric discs, each of the eccentric discs being seated on one of the respective crankshafts, wherein said eccentric discs are equipped to compensate eccentricity of the piston statically and dynamically in any position of the piston.

2. The oscillating piston engine according to claim 1, wherein a compressed-air supply is arranged to supply the engine with oil mist-moistened compressed air, so that all moveable parts and their sliding surfaces always run lubricated on one another, unused lubricating oil can collect in multiple channels in the piston, from where it is redistributed by the piston.

3. The oscillating piston engine according to claim 1, wherein the exhaust ports of the combustion chambers are connected to two exhaust pipes so that the first, the third and the fifth exhaust ports are connected to one of the exhaust pipes, and the second, the fourth and the sixth exhaust ports are connected to another one of the exhaust pipes in order to avoid backfiring.

* * * * *